US006202908B1

(12) United States Patent
Groover

(10) Patent No.: US 6,202,908 B1
(45) Date of Patent: Mar. 20, 2001

(54) SPARE MAGAZINE CARRIER WITH RETRACTABLE FLAP

(76) Inventor: J. Steven Groover, 11625 Falconhill Dr., Whittier, CA (US) 90604

( * ) Notice: Subject to any disclaimer, the term of this patent is extended or adjusted under 35 U.S.C. 154(b) by 0 days.

(21) Appl. No.: 09/481,872

(22) Filed: Jan. 12, 2000

(51) Int. Cl.[7] ..... F42B 39/02

(52) U.S. Cl. ..... 224/239; 224/236; 224/237; 224/240; 224/931

(58) Field of Search ..... 224/196, 235, 224/236, 237, 239, 240, 241, 242, 245, 931

(56) References Cited

U.S. PATENT DOCUMENTS 2,763,411 * 9/1956 Werner ..... 224/239
5,174,482 * 12/1992 Rogers et al. ..... 224/239
5,484,093 * 1/1996 Hellweg et al. ..... 224/239
5,617,582 * 4/1997 Burwell ..... 2/102
6,050,464 * 4/2000 Ramsey, Sr. et al. ..... 224/196

* cited by examiner

*Primary Examiner*—Stephen K. Cronin
(74) *Attorney, Agent, or Firm*—Egdar W. Averill, Jr.

(57) ABSTRACT

A spare magazine carrier for carrying at least one ammunition magazine on a user's person. The spare magazine carrier has a carrier frame for seating and supporting at least one ammunition magazine, and a downwardly retractable flap for covering and retaining the seated ammunition magazine. The flap has an elastic member connecting a lower flap end with an upper flap end. The lower flap end is secured to a lower portion of the carrier frame, and the upper flap end is detachably securable to a top end of the carrier frame by resiliently extending over and around an upper exposed portion of the seated ammunition magazine in a preferably inverted U-shaped configuration. When the upper flap end is released, the elastic member causes the upper flap end to retract down and away from the opening, and thereby allow unobstructed access to the ammunition magazine.

20 Claims, 3 Drawing Sheets

SPARE MAGAZINE CARRIER WITH RETRACTABLE FLAP

BACKGROUND OF THE INVENTION

The field of the invention generally pertains to magazine holders and carriers. The invention relates more particularly to a spare magazine carrier for securing ammunition magazines on a user's person by means of a flap capable of retracting down and away from a pocket opening when released from a secured position. In this manner, the user can quickly, easily, and unobstructedly access one or more ammunition magazines seated therein for rapid reloading of a firearm.

With the evolution of $20^{th}$ Century small arms weaponry came the ammunition magazine pre-loaded with multiple ammunition cartridges, and the corresponding need to carry extra ammunition magazines in order to reload a firearm. Consequently, various magazine holders and carriers mounted on the user's person were developed to provide a convenient means for transporting and making available one or more spare ammunition magazines. Magazine carriers function to secure magazines in their place and protect them against damage, malfunction, and/or loss, especially during the rigorous conditions commonly encountered in combat by law enforcement and military personnel.

Moreover, because spare magazines are oftentimes utilized during extreme life-threatening combat situations, magazine carriers must allow rapid and easy access to a full magazine for reloading and resuming fire with minimal delay. In particular, it is often critical for magazine carriers to enable the release, access, and acquisition of a spare magazine with the non-firing free hand, while maintaining a grip on the firearm with the firing hand. For this reason, magazine carriers are typically mounted or fastened on a belt, vest, or other garment worn by the user, where it is within easy reach of the user's free hand. Failure to quickly reload a full magazine while engaged in a gun battle can mean serious injury, capture, and/or death.

One common example of a spare magazine carrier incorporates a top flap which folds down and over an exposed upper portion of a magazine seated within a pouch, much like a button down shirt pocket. Typically, the top flap has one end attached to the back of a pocket or pouch, and a free end which folds down and over a seated magazine and fastens to a front side of the pouch by a detachable snap fastener. The snap fastener has a male (or female) portion on the free end of the top flap, and a corresponding female (or male) portion attached to the front side of the pouch.

Perhaps the greatest problem with the top flap magazine carrier, however, is the numerous movements required to access a spare magazine contained therein. Typically this requires five distinct movements which must be independently executed by the non-firing free hand. First, the user must unfasten the flap from the front portion of the pouch. Second, the user must then raise the flap up to clear the exit path. Third, the user must hold the flap up and out of the way. Fourth, the user then grasps the magazine. And finally, the user withdraws the magazine from the carrier and commences reloading of the firearm. While this design provides sufficient security against loss, it can effectively hinder the rapid access and deployment of magazines for quick reloading of a weapon. Moreover, in addition to the delay caused by the number of movements involved, the interfering presence of the flap in the exit path of the magazine in steps three and four can also sufficiently hinder access to the magazine which can cause mishandling and loss of the magazine.

Additionally, in U.S. Pat. No. 5,617,582, a load bearing vest is shown having pouches 140 with corresponding flaps 148 which utilize a drawstring 162 to lift and hold the flaps up and away from the pouch while accessing an ammunition magazine seated in the pouch. The problem with this design, however, is that while it eliminates step three in the five step procedure discussed above, the operation of the pouch still requires lifting of the flap, i.e. step two above, by pulling the drawstring. Further, and perhaps more importantly, the flap still obstructs access to the magazine because it is still essentially a top flap magazine carrier as described above. Consequently, even when pulled open using a drawstring 162 , the flap still remains in the exit path of the spare magazine. Under high stress and demanding situations common during combat, the presence of even a fully retracted flap may interfere and hinder the deployment of the fresh magazine, and thereby jeopardize the safety of the user.

In a third common magazine carrier design disclosed in U.S. Pat. No. 5,484,093, the top flap is eliminated altogether which obviates the obstruction problem caused by a top flap, and thus facilitates speedy access. The magazine pouch in the 093 patent utilizes a tensioning bolt 22 to friction fit a spare magazine in a main body portion 10. However, retention of magazines by friction fit can be unreliable, especially in rigorous combat situations. Intense physical movement and activity during combat can cause dislodging and loss of the magazine, which would otherwise have been retained by a protective flap or other catch mechanism. In this arrangement, therefore, security is sacrificed for speed and the magazine is always susceptible to damage or loss.

In summary, there is a need for a spare magazine carrier mountable on a user's person which is capable of securely retaining at least one spare ammunition magazine, and providing simple, immediate, and unobstructed access to the at least one spare ammunition magazine when needed. In particular, while a flap is preferably used to properly retain a spare magazine, it would be advantageous to remove the flap completely away from an access/exit path of the spare magazine when access is desired.

BRIEF SUMMARY OF THE INVENTION

It is an object of the present invention to provide a simple, durable, and reliable spare magazine carrier mountable on a user's person, which is capable of securely retaining one or more spare ammunition magazines in the carrier, and providing convenient, immediate, and unobstructed access to the one or more spare ammunition magazines when desired or needed.

It is a further object of the present invention to provide a simple, durable, and reliable spare magazine carrier mountable on a user's person, for protectively covering one or more spare ammunition magazines to prevent damage, malfunction and/or loss of the magazines prior to use.

It is a still further object of the present invention to provide a spare magazine carrier which is simply and conveniently mountable anywhere on a user's person within easy reach of the user.

The present invention is for a spare magazine carrier securable on a user's person for carrying at least one ammunition magazine. In a preferred embodiment, the spare magazine carrier has a carrier frame including a base wall with a top end and a bottom end, pocket means connected to the base wall for seating at least one ammunition magazine against the base wall through at least one pocket opening, and means for mounting the carrier frame to the user's person. Additionally, the spare magazine carrier has at least one flap member with a lower flap end, an upper flap end, and means for downwardly retracting the upper flap end away from the at least one pocket opening when released. The lower flap end is connected to a lower portion of the carrier frame, and the upper flap end is extendable over an upper portion of the at least one ammunition magazine and detachably securable to the top end of the base wall by detachably securing means. Upon release of the detachably securing means, the means for downwardly retracting the upper flap, preferably a resilient elastic member, operates to retract away the upper flap end from the pocket opening, to thereby provide unobstructed access to the at least one ammunition magazine.

DETAILED DESCRIPTION OF THE PREFERRED EMBODIMENTS

Figure 1:
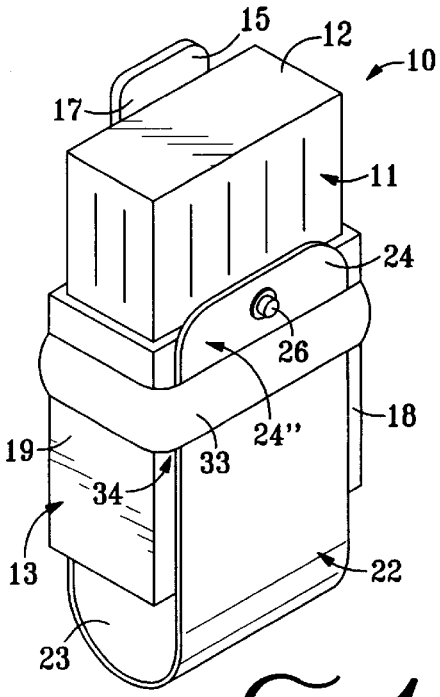
FIG. 1 is a front perspective view of a first preferred embodiment of the spare magazine carrier, shown with an ammunition magazine seated therein and the flap member in a retracted position.

Referring now to the drawings, FIGS. 1–9 show the spare magazine carrier, generally indicated at reference character 10, for securing a spare ammunition magazine 11 on a user's person. The spare magazine carrier 10 generally has two main components: namely, a carrier frame, generally indicated at reference character 13, and a flap member, generally indicated at reference character 22. The carrier frame 13 generally functions as the platform of the magazine carrier 10 for seating a spare magazine 11 against the user's person, while the flap member generally functions to securely retain the magazine 11 in the carrier frame 13.

Figure 2:
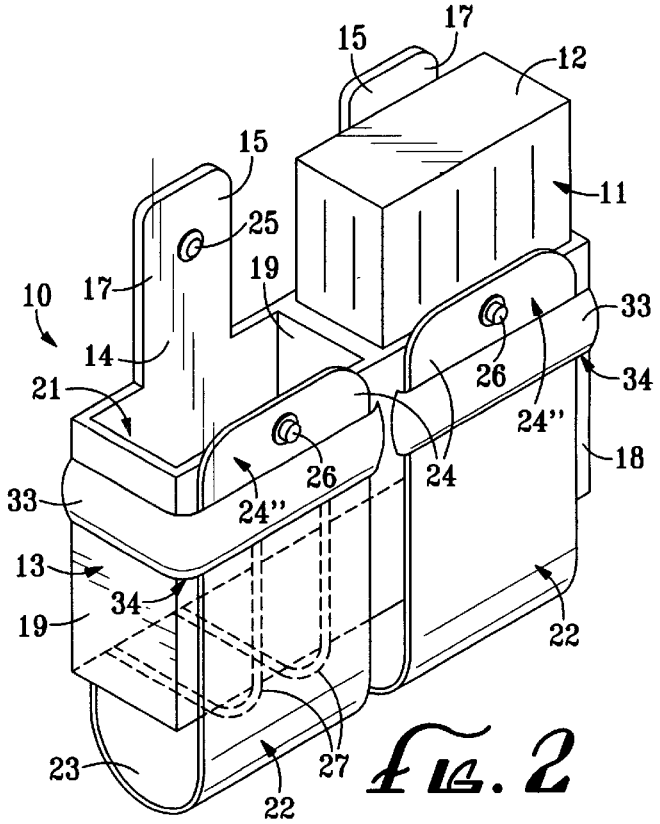
FIG. 2 is a front perspective view of a dual-cell example of the first preferred embodiment of the spare magazine carrier, shown with one ammunition magazine seated in the carrier, and the two flap members in the retracted position.

As can be seen in FIGS. 1–8, showing a first preferred embodiment of the magazine carrier 10, the carrier frame 13 has at least one pocket or cell with at least one pocket opening 21 for receiving a magazine 11 therein. FIGS. 1 and 2 show exemplary single-cell and dual-cell embodiments, respectively, of the first preferred embodiment. However, the magazine carrier 10 can also be embodied having multiple cells or pockets over and beyond two cells, for seating a plurality of magazines 11.

The carrier frame 13 of the first preferred embodiment comprises a base wall 14, a bottom wall 20, a front wall 18, and side walls 19 connecting the front wall 18 to the base wall 14, thereby forming and defining the at least one pocket with at least one pocket opening 21. The base wall 14, front wall 18, side walls 19, and bottom wall 20 together provide lateral and subjacent support for a seated magazine 11. The base wall 14 has a generally flat shape with a top end 15 and a bottom end 16. One side of the base wall 14 abuts against the user's person (not shown), and the opposite side contactedly faces a seated magazine 11. As can be seen in FIGS. 1–9, the top end 15 of the base wall 14 is preferably shaped to form a tab portion 17. The tab portion 17 is preferably an extension of the main base wall 14 and is preferably constructed of the same material as the main base wall 14. Preferably, as can be best seen in FIG. 2, a separate tab portion 17 coextends from the base wall 14 for each pocket of the carrier frame 13. Although the tab portion 17 is preferably rigid, it is capable of flexing sufficiently to allow detachment of a first fastener 25 affixed to the tab portion 17 from a second fastener 26 affixed to the flap member 22, as will be further discussed below.

The front wall 18 and side walls 19 can have a low or high cut, wherein more or less, respectively, of the seated magazine 11 is exposed when seated in the carrier frame. It is notable, that a low cut carrier has a speed and convenience advantage over a high cut carrier by allowing the ammunition magazine 11 to be more easily grasped and withdrawn. In one particular embodiment, the spacing and retention of the walls, particularly the base and front walls 13, 18, may also be adjusted, whereby a friction grip may be applied or released on the seated ammunition magazine 11 in order to snugly accommodate the same.

Figure 3:
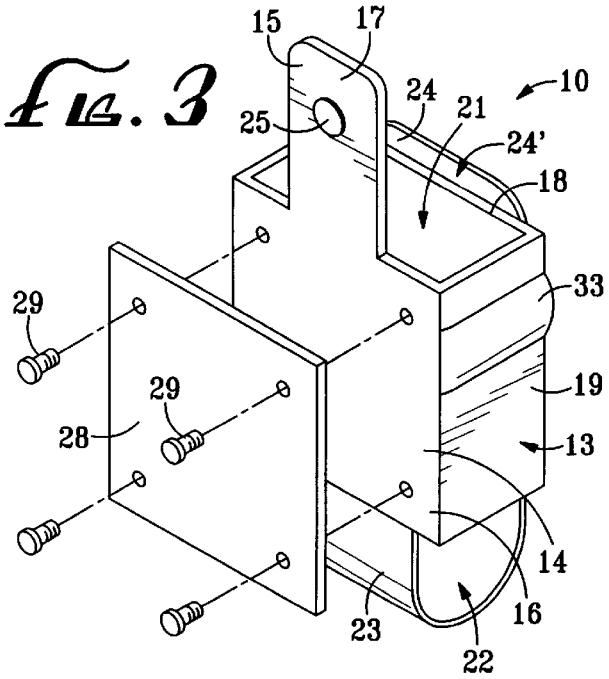
FIG. 3 is a rear perspective view of the spare magazine carrier illustrating a first preferred embodiment of the means for mounting to the user's person which is a modular mounting assembly.
Figure 4:
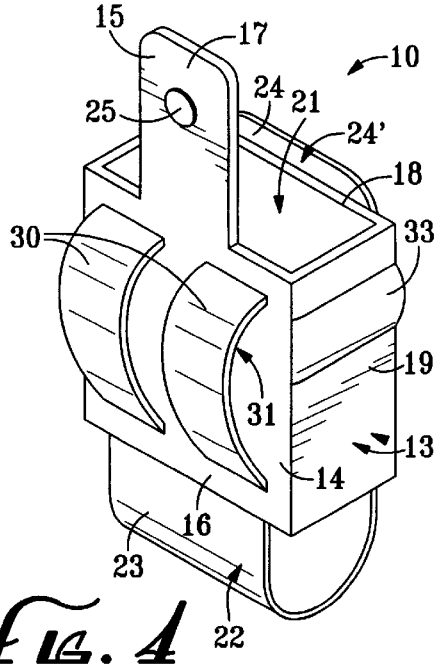
FIG. 4 is a rear perspective view of the spare magazine carrier illustrating a second preferred embodiment of the means for mounting to the user's person which is a belt loop.

The carrier frame 13 is mountable on the user's person at a conveniently accessible location, such as on a belt, vest, harness, or other garment worn by the user. As can be seen in FIG. 3 showing a first preferred embodiment of the means for mounting the carrier frame 13 to the user's person, the means for mounting is a modular mounting assembly comprising a back plate 28 and a plurality of fasteners, such as screws 29, for releasably fastening the back plate 28 to the base wall 14. Preferably, both the back plate 28 and the base wall 14 have pre-drilled holes through which the fasteners may partially pass when mounting to the user. When fastening the magazine carrier 10 to the user, the back plate 28 is positioned inside the user's vest or other garment, against an interior side of the garment (not shown). Preferably the screws 29 are then partially extended through the pre-drilled holes of the back plate 28, through the garment, and into the pre-drilled holes of the base wall 14 where they are detachably secured. Alternatively, as can be seen in FIG. 4, the means for mounting the carrier frame 13 may be at least one belt loop 30 connected to the base wall 14, and defining a loop channel 31. The belt loop(s) 30 may be integrally formed or affixed on the base wall 14. In any case, the magazine carrier 10 is mounted on the user's person by sliding a belt worn by the user (not shown) through the loop channel 31.

Construction of the carrier frame 13 can be made of any light weight rigid material. It can be made from natural materials such as leather, or synthetic materials such as the polycarbonate material sold under the trademark "Kydex." It is notable that "Kydex" retains it shape and resiliency particularly well against heat, moisture, wear, and body chemicals, is economical to produce, and has less bulk and weighs less than leather, and is therefore a preferred material for the carrier frame 13. It is notable that the carrier frame 13 would function equally as well if constructed entirely of a non-rigid material or fabric. This is due to the tension produced in the base wall 14 by the elastic member 27, when the flap member 22 is positioned to detachably secure the seated magazine 11, as will be discussed below.

As can be seen in FIGS. 1–9, the retractable flap member 22 is positioned adjacent the front wall 18. The flap member 22 has a lower flap end 23 connected to a lower portion of the carrier frame 13, an upper flap end 24 extendable over an upper portion 12 of the seated magazine 11, and means for downwardly retracting the upper flap end 24 away from the pocket opening 21 when the upper flap end 24 is released from a detachably secured position along the top end 15 of the base wall 14 (see below). Preferably, the means for downwardly retracting is an elastic member 27 (See FIGS. 2 and 9) which connects the upper flap end 24 with the lower flap end 23. The elastic member 27 can be a resilient flap, cord, leash, etc., having a relatively high modulus of elasticity with an ability to recover its size and shape after being biased.

As can be seen in FIGS. 1–9, the lower flap end 23 is preferably connected to the bottom end 16 of the base wall 13. As shown in FIGS. 1–4, 7–9, the flap member 22 hangs loosely below the bottom wall 20 when in the fully retracted state, and alongside the bottom wall 20 when in the extended and detachably secured state. However, the elastic member 27 is positioned alongside the bottom wall 20 near the lower flap end 23, both in the retracted and detachably secured states. This is due to the difference in length between the unbiased elastic member 27 and the flap member 22, the unbiased elastic member 27 having a shorter length than the flap member 22. Thus, the slack in the flap member 22 which hangs loosely below the bottom wall 20 when in the fully retracted state, enables the flap member 22 to extend over the upper portion 12 of the seated magazine 11.

Figure 7:
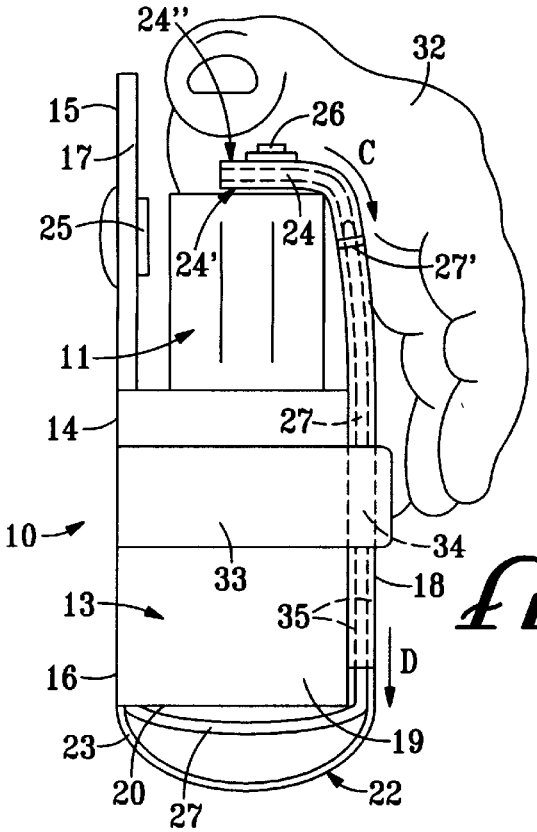
FIG. 7 is a dynamic elevational view similar to and following FIG. 6, showing the flap member downwardly retracting away from the pocket opening and exit path.
Figure 7A:
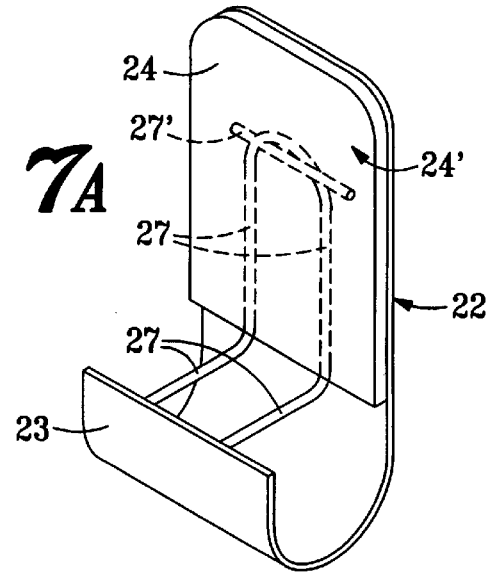
FIG. 7A is a reversed perspective view of the flap member 22 showing the inner surface of the flap, and illustrating the relationship between the elastic member and the flap member.

Alternatively, the lower flap end 23 may be connected to a lower portion of the front wall 18. While the exact attachment location of the lower flap end 23 is not critical, a sufficient distance is maintained between the upper flap end 24 and the lower flap end 23 when in the unbiased, fully retracted state, i.e. when the elastic member 27 remains unstretched. This is to allow greater displacement of the flap member 22 to thereby enable the extension of the upper flap end 24 over the upper portion 12 of the magazine 11, as well as guarantee complete retraction of the upper flap end 24 away from the pocket opening 21 when detachably released (See discussion below). The point of attachment of the lower flap end 23 will effect the resilient biasing of the magazine carrier 10: the further away the lower flap end 23 is secured from the upper flap end 24, the greater the resiliency. And preferably, as can be seen in FIG. 7, near the front wall 18, the flap member 22 is constructed of two layers 35 which togther define a flap pocket through which the elastic member 27 may extend into and secured to the flap member 22 by an anchor 27' (FIG. 7A). This can also be seen in FIG. 7A showing a reversed perspective view of the flap member 22, and particularly showing the inner surface 24' of the flap member 22. The two layers 35 are made of durable, yet flexible material that will bend. As shown in FIGS. 5–8, the double layers 35 are not adjacent the bottom wall 20 of the carrier frame 13 because at that point, the flap member 22 and the elastic member 27 are allowed to diverge.

The upper flap end 24 is detachably securable to the top end 15 of the base wall 14, i.e. the tab portion 17, by a detachable fastener. The detachable fastener is preferably a thumb-breakable snap fastener capable of detaching with a single snap motion, and having a first snap connector 25 and a second snap connector 26. The first snap connector 25 is affixed to the tab portion 17 of the carrier frame 13, and the second snap connector 26 is affixed to the upper flap end 24 of the flap member 22. Moreover, the fastening portion of the second snap connector 26 is affixed on an outer surface 24" of the upper flap end 24. An inner surface 24' of the upper flap end 24 faces the seated magazine 11, while the outer surface 24" is faced in an opposite direction. In this manner, when the flap member 22 is detachably secured to the tab portion 17 by means of the snap fastener, the flap member 22 forms an inverted U-shaped configuration around the upper portion 12 of the seated magazine 11. This ready-and-poised configuration of the flap member 22 enables simple and quick release of the flap member 22, as will be discussed below.

As shown in the drawings, the magazine carrier 10 also includes a flap guide 33 which guides the flap member 22 to slide alongside the front wall 18, between the front wall 18 and a seated magazine 11, when released. The flap guide 33 is attached to the carrier frame 13 and forms a flap guide channel 34 (see FIGS. 5–8) through which the flap member 22 extends. It is preferably constructed from a thin, durable and lightweight material similar to that of the carrier frame 13. The flap guide 33 functions to guide the withdrawing motion of the detached flap member 22 downward when the snap fastener is disengaged. In this manner, the retracting flap member 22 may be prevented from experiencing an outwardly-directed whipping action that may be caused by a sudden retraction.

Figure 5:
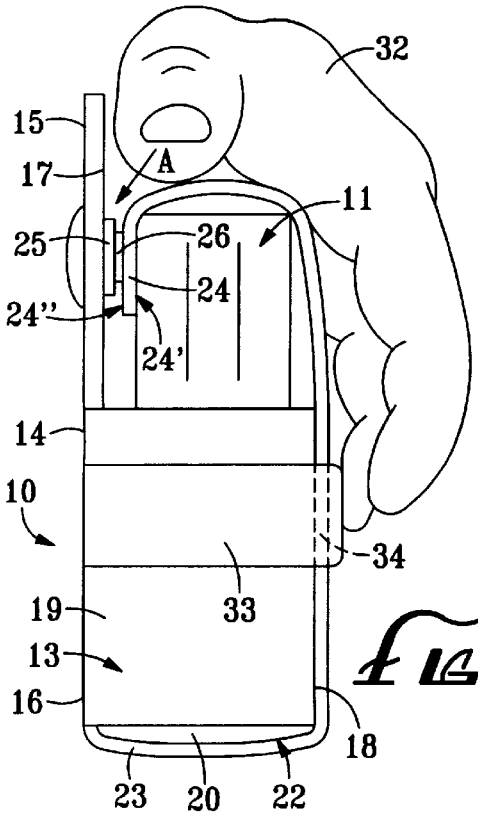
FIG. 5 is a dynamic elevational view of the spare magazine carrier as generally seen from the side, prior to a user releasing the snap fastener.
Figure 6:
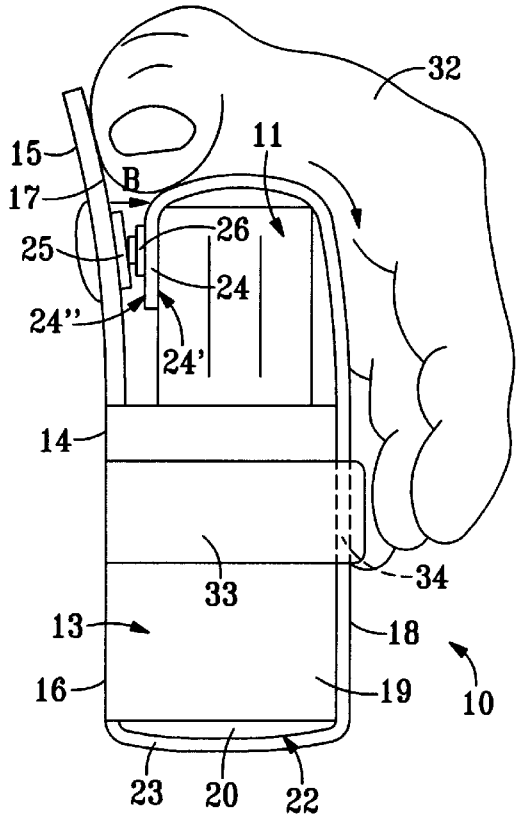
FIG. 6 is a dynamic elevational view similar to and following FIG. 5, showing the user releasing the snap fastener.
Figure 8:
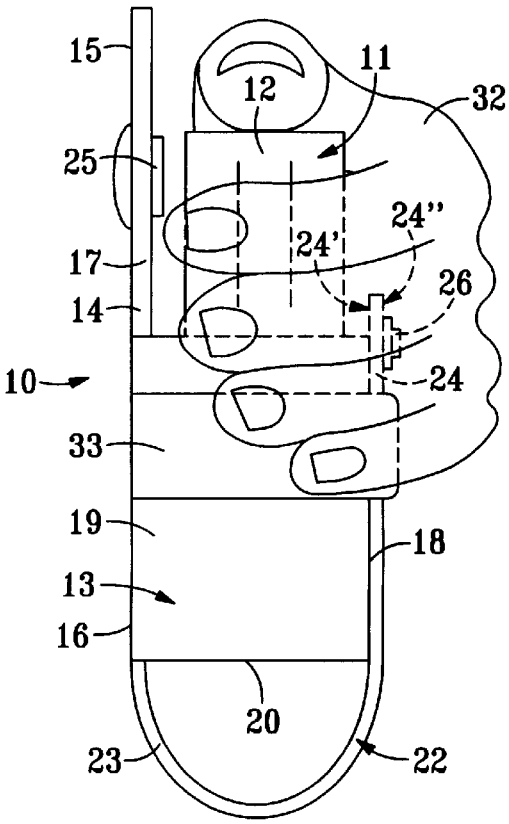
FIG. 8 is a dynamic elevational view similar to and following FIG. 7, showing the flap member at rest in the fully retracted position.

The release operation of the flap member 22 to provide an unobstructed exit path for the seated magazine 11 can be best seen in FIGS. 5–8. In FIG. 5, the magazine carrier 10 is shown in the detachably secured positioned prior to release, with the user's non-firing hand 32 positioned to release the flap member 22. In this view, the user's thumb is positioned adjacent the tab portion 17 and the upper flap end 24 near the connected first and second snap connectors 25, 26. The inverted U-shaped configuration of the flap member 22 enables the user's hand to descend upon the snap fasteners from above in a natural motion, and the user's thumb to be optimally positioned for detaching the snap fastener. As can be seen in FIG. 5, the user's thumb applies a pressure in the direction of arrow A which operates to cleave and separate the snap connectors 25 and 26. This can be best seen in FIG. 6 following FIG. 5, showing the sufficient flexing of the tab portion 17 away from the seated magazine 11 to release the second snap connector 26. Arrow B indicates the detachment and relative movement of the second snap connector 26 as it is detachably released. Next, as shown by arrows C and D in FIG. 7, the flap member 22 is pulled in a downward direction by the contracting elastic member 27. The upper flap end 24 is pulled clear of the pocket opening 21 and exit path of the seated magazine 11 until the fully retracted position is reached, as shown in FIG. 8. At this point, the user may grasp the upper portion 12 of the magazine 11 without any obstruction from the magazine carrier 10.

The advantage of this elastic retracting action is realized during combat situations where a firearm must be reloaded under intensely stressful situations. Typically, the firing hand and the non-firing hand must each perform separate and independent actions to reload a firearm. The firing hand must release the expended magazine from the firearm, which is typically accomplished by a magazine release lever or button mounted on the handgun, while continuing to hold the firearm in the fire-ready position. Concurrently, the non-firing hand must independently reach for, access, and acquire the seated magazine 11. In the present invention, the combined operation of the snap fastener and the resiliently biased elastic member 27 enables a quick release and retraction of the flap member 22 with a single motion, to thereby provide immediate access and acquisition of the spare magazine 11 without unnecessarily cumbersome additional steps. Moreover, absence of a top flap prevents the possibility of the top flap snagging on an external object or surface, which can cause the opening of the flap, and the subsequent release of the magazine contained therein. The particular inverted U-shaped configuration of the present invention effectively prevents such snagging and inadvertent opening.

Figure 9:
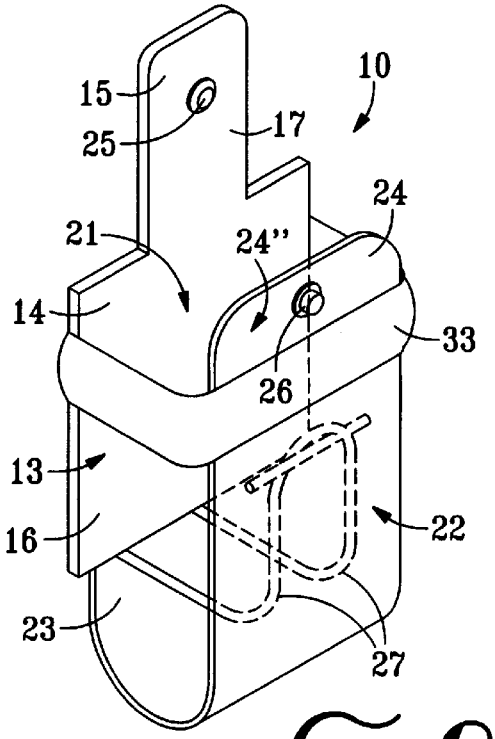
FIG. 9 is a front perspective view of a second preferred embodiment of the spare magazine carrier, shown without an ammunition magazine, with the flap member in the retracted position.

FIG. 9 illustrates a second preferred embodiment of the magazine carrier 10 having a similar configuration as the first preferred embodiment, but without a front wall 18, side walls 19 and a bottom wall 20 of the first preferred embodiment (as shown in FIGS. 1–8). As can be seen in FIG. 9, the magazine carrier 10 comprises a base wall 14 with a top end 15 and a bottom end 16, a flap member 22, and a lateral restraint 33, e.g. a flap guide. The flap member 22 has a lower flap end 23 connected to the bottom end 16 of the base wall 14, an upper flap end 24 adjacent and inner surface of the lateral restraint 33, and means for downwardly retracting the upper flap end 24 away from a pocket opening 21 of the magazine carrier 10, which is preferably an elastic member 27. In this embodiment, however, the flap member 22 contactedly extends between the lateral restraint 33 and a magazine seated in the pocket. Moreover, the elastic member 27 operates as a lower bound and thus provides subjacent support to a magazine seated in the magazine carrier 10. In this configuration the magazine carrier 10 is capable of sufficiently seating and securing the seated magazine, as well as elastically retracting the flap member 22, without the need for a rigid carrier frame. The magazine itself provides the rigidity necessary to produce the tension in the stretched elastic member 27 when extended and detachably secured. Thus, even in this second embodiment, the carrier frame 10 may be constructed of a non-rigid material or fabric, without sacrificing the operation of the magazine carrier 10.

While reference to "top" or "upper" e.g. top end 15, and "bottom" or "lower", e.g. bottom end 16, generally indicates a vertical orientation of the magazine carrier 10 aligning with the upright stance of a user's person, the magazine carrier 10 is not limited only to such. Rather, the magazine carrier 10 can be oriented in a manner which allows convenient, and easy access to the ammunition magazine located therein.

The present embodiments of this invention are thus to be considered in all respects as illustrative and not restrictive, and have been chosen only for purposes of disclosure; the scope of the invention being indicated by the appended claims rather than by the foregoing description. All changes which come within the meaning and range of equivalency of the claims are intended to be embraced therein.

I claim:

1. A spare magazine carrier securable on a user's person for carrying at least one ammunition magazine, said spare magazine carrier comprising:

a carrier frame having a base wall with a top end and a bottom end, pocket means connected to said base wall for seating said at least one ammunition magazine thereagainst, said pocket means having at least one pocket opening for receiving said at least one ammunition magazine therethrough, and means for mounting said carrier frame to said user's person; and at least one flap member adjacent a front portion of said pocket means and having a lower flap end connected to a lower portion of said carrier frame, an upper flap end extendable over an upper portion of said at least one ammunition magazine seated in said at least one pocket opening, said upper flap end detachably securable to the top end of said base wall by detachably securing means, and means for downwardly retracting the upper flap end away from said at least one pocket opening upon release of said detachably securing means, thereby providing unobstructed access to said at least one ammunition magazine.

2. The spare magazine carrier as in claim 1, wherein said means for downwardly retracting the upper flap end from said at least one pocket opening is an elastic member connecting the upper flap end with the lower flap end.

3. The spare magazine carrier as in claim 1, wherein the upper flap end has an inner surface facing said at least one ammunition magazine seated in said at least one pocket opening, and an oppositely facing outer surface; and wherein said at least one flap member forms a generally inverted U-shaped configuration around the upper portion of a corresponding at least one ammunition magazine when the outer surface of the upper flap end is detachably secured to the top end of said base wall.

4. The spare magazine carrier as in claim 3, wherein said detachably securing means is a snap fastener assembly comprising a first snap connector affixed to the top end of said base wall, and a second snap connector affixed to the outer surface of the upper flap end and capable of matingly and detachably securing to the first snap connector.

5. The spare magazine carrier as in claim 1, further comprising a flap guide connected to said carrier frame and bordering said pocket means to form at least one guide channel therebetween, whereby said at least one flap member may captively slide through said at least one guide channel alongside said pocket means when a corresponding one of said detachably securing means is released.

6. The spare magazine carrier as in claim 1, wherein said means for mounting said carrier frame to said user's person comprises a modular mounting assembly including a back plate and means for releasably fastening said back plate to said base wall, said back plate positioned against an interior side of a garment worn by said user, and said means for releasably fastening partially extending through said back plate and said garment and releasably fastening to said base wall.

7. The spare magazine carrier as in claim 1, wherein said means for mounting said carrier frame to said user's person comprises at least one belt loop connected to said base wall, whereby a belt secured on said user's person may be slidably extended therethrough.

8. A spare magazine carrier securable on a user's person for carrying at least one ammunition magazine, said spare magazine carrier comprising:

a base wall having a top end, a bottom end, and means for mounting said base wall to said user's person;

a lateral restraint member connected to said base wall for seating said at least one ammunition magazine thereagainst, said lateral restraint member defining at least one pocket opening for receiving said at least one ammunition magazine therein, said lateral restraint member and said at least one ammunition magazine thus seated forming at least one guide channel therebetween;

at least one flap member positioned through said at least one guide channel and having a lower flap end connected to the bottom end of said base wall, an upper flap end extendable over an upper portion of said at least one ammunition magazine seated in said at least one pocket opening and detachably securable to the top end of said base wall by detachably securing means, and means for downwardly retracting the upper flap end away from said at least one pocket opening upon release of said detachably securing means, thereby providing unobstructed access to said at least one ammunition magazine.

9. The spare magazine carrier as in claim 8, wherein said means for downwardly retracting the upper flap end from said at least one pocket opening is an elastic member connecting the upper flap end with the lower flap end.

10. The spare magazine carrier as in claim 8, wherein the upper flap has an inner surface facing said at least one ammunition magazine seated in said at least one pocket opening, and an oppositely facing outer surface; and wherein said flap member forms a generally inverted U-shaped configuration around the upper portion of said at least one ammunition magazine when the outer surface of the upper flap end is detachably secured to the top end of said base wall.

11. The spare magazine carrier as in claim 10, wherein said detachably securing means is a snap fastener assembly comprising a first snap connector affixed to the top end of said base wall, and a second snap connector affixed to the outer surface of the upper flap end and capable of matingly and detachably securing to the first snap connector.

12. The spare magazine carrier as in claim 8, wherein said means for mounting said base wall to said user's person comprises a modular mounting assembly including a back plate and means for releasably fastening said back plate to said base wall, said back plate positioned against an interior side of a garment worn by said user, and said means for releasably fastening partially extending through said back plate and said garment and releasably fastening to said base wall.

13. The spare magazine carrier as in claim 8, wherein said means for mounting said base wall to said user's person comprises at least one belt loop connected to said base wall, whereby a belt secured on said user's person may be slidably extended therethrough.

14. A spare magazine carrier securable on a user's person for carrying at least one ammunition magazine, said spare magazine carrier comprising:

a carrier frame having a base wall with a top end and a bottom end, a front wall opposite the base wall, opposing sidewalls connecting said front and base walls, a closed lower end, an upper end opposite the closed lower end having at least one pocket opening for receiving said at least one ammunition magazine therethrough, and means for mounting said carrier frame to said user's person; and at least one flap member adjacent said front wall and having a lower flap end connected to a lower portion of said carrier frame, an upper flap end extendable over an upper portion of said at least one ammunition magazine seated in said at least one pocket opening and detachably securable to the top end of said base wall by detachably securing means, and means for downwardly retracting the upper flap end away from said at least one pocket opening upon release of said detachably securing means, thereby providing unobstructed access to said at least one ammunition magazine.

15. The spare magazine carrier as in claim 14, wherein said means for downwardly retracting the upper flap end from said at least one pocket opening is an elastic member connecting the upper flap end with the lower flap end.

16. The spare magazine carrier as in claim 14, wherein the upper flap has an inner surface facing said at least one ammunition magazine seated in said at least one pocket opening, and an oppositely facing outer surface; and wherein said flap member forms a generally inverted U-shaped configuration around the upper portion of said at least one ammunition magazine when the outer surface of the upper flap end is detachably secured to the top end of said base wall.

17. The spare magazine carrier as in claim 16, wherein said detachably securing means is a snap fastener assembly comprising a first snap connector affixed to the top end of said base wall, and a second snap connector affixed to the outer surface of the upper flap end and capable of matingly and detachably securing to the first snap connector.

18. The spare magazine carrier as in claim 14, further comprising a flap guide connected to said carrier frame and bordering said front wall to form at least one guide channel therebetween, whereby said at least one flap member may captively slide through said at least one guide channel alongside said front wall when a corresponding one of said detachably securing means is released.

19. The spare magazine carrier as in claim 14, wherein said means for mounting said carrier frame to said user's person comprises a modular mounting assembly including a back plate and means for releasably fastening said back plate to said base wall, said back plate positioned against an interior side of a garment worn by said user, and said means for releasably fastening partially extending through said back plate and said garment and releasably fastening to said base wall.

20. The spare magazine carrier as in claim 14, wherein said means for mounting said carrier frame to said user's person comprises at least one belt loop connected to said base wall, whereby a belt secured on said user's person may be slidably extended therethrough.

* * * * *